US010342319B1

(12) United States Patent
Alabdulkarim

(10) Patent No.: US 10,342,319 B1
(45) Date of Patent: Jul. 9, 2019

(54) WEARABLE LOAD CARRIER

(71) Applicant: KING SAUD UNIVERSITY, Riyadh (SA)

(72) Inventor: Saad Abdulmohsen M. Alabdulkarim, Riyadh (SA)

(73) Assignee: King Saud University, Riyadh (SA)

( * ) Notice: Subject to any disclaimer, the term of this patent is extended or adjusted under 35 U.S.C. 154(b) by 0 days.

(21) Appl. No.: 16/121,882

(22) Filed: Sep. 5, 2018

(51) Int. Cl.

| | |
|---|---|
| ***A45F 3/04*** | (2006.01) |
| ***A45F 3/08*** | (2006.01) |
| ***A45F 3/10*** | (2006.01) |
| *A45F 3/14* | (2006.01) |

(52) U.S. Cl.
CPC ..... *A45F 3/08* (2013.01); *A45F 3/10* (2013.01); *A45F 2003/045* (2013.01); *A45F 2003/146* (2013.01)

(58) Field of Classification Search
CPC ..... A45F 3/08; A45F 3/10; A45F 3/04; A45F 3/047; A45F 2003/045
See application file for complete search history.

(56) References Cited

U.S. PATENT DOCUMENTS 2,925,205 A 2/1960 Hunt
3,733,017 A * 5/1973 Pletz ..... A45F 3/08 224/235
3,899,109 A 8/1975 Noice
4,013,201 A * 3/1977 Potter ..... A45F 3/047 224/262
4,135,654 A * 1/1979 Chu ..... A45F 3/08 224/261
4,480,775 A * 11/1984 Stanford ..... A45F 3/14 224/161
4,489,866 A * 12/1984 Korte ..... A45F 4/02 224/155
4,582,165 A * 4/1986 Latini ..... A01M 31/02 108/152
5,205,450 A * 4/1993 Derosier ..... A47D 13/025 224/161
5,492,255 A * 2/1996 Gansky ..... A01M 31/02 224/153

(Continued)

OTHER PUBLICATIONS

Putrelio Lift Assist Work Belt, printed from Solo Scientific, Inc. website on Jun. 8, 2018 (3 pages), http://www.soloscientific.com/puliaslibe.html.

(Continued)

*Primary Examiner* — Brian D Nash
(74) *Attorney, Agent, or Firm* — Richard C. Litman

(57) ABSTRACT

The wearable load carrier is a body-mounted carrier for carrying and transporting loads, such as boxes, packages, containers and the like. The wearable load carrier is supported by the back or torso and shoulders of the user, and is adjustable to receive and carry loads of varying sizes and configurations. The wearable load carrier includes a pair of rails, each having an upper end and a lower end, which partially define a carrier frame. A support platform is provided for supporting the load. The support platform includes front and rear edges, the front edge being selectively secured to and extending between the pair of rails at an adjustable height and tilt. A pair of shoulder straps, a waist strap and a chest strap are provided for releasably securing the carrier to the user's back or torso.

9 Claims, 5 Drawing Sheets

(56) References Cited

U.S. PATENT DOCUMENTS 5,564,612 A * 10/1996 Gregory ..... A45F 3/08 224/633
5,762,251 A * 6/1998 Gleason ..... A45F 3/047 224/635
5,806,740 A * 9/1998 Carlson ..... A45F 3/047 224/259
5,878,928 A * 3/1999 Seiber ..... A45F 3/04 224/153
6,199,732 B1 * 3/2001 Swetish ..... A45F 3/04 224/262
6,460,746 B1 * 10/2002 Amram ..... A45F 3/047 224/579
7,703,645 B2 4/2010 Moskun
8,056,779 B1 * 11/2011 Brunwin ..... A47D 13/025 224/160
9,232,848 B2 * 1/2016 Krikorian ..... A45F 3/08
9,402,456 B2 * 8/2016 Shtriker ..... A45F 3/047
9,713,391 B2 * 7/2017 Telford ..... A47D 13/025
2004/0065704 A1 4/2004 Penny et al.
2006/0196215 A1 9/2006 Crumlin et al.
2014/0209646 A1 7/2014 Hoppa
2017/0311703 A1 * 11/2017 Wistrand ..... A45F 3/08

OTHER PUBLICATIONS

"StrongArm® EgroskeletonTM V22 Lift Assist Device" product brochure, printed on Jun. 8, 2018 (2 pages); http://multimedia.3m.com/mws/media/1182159O/strongarm-v22-sell-sheet.pdf.

Muslim, Khoirul, and Maury A. Nissbaum. "The effects of a simple intervention on exposures to low back pain risk factors during traditional posterior load carriage." Applied ergonomics 59 (2017): 313-319.

* cited by examiner

WEARABLE LOAD CARRIER

BACKGROUND

1. Field

The disclosure of the present patent application relates to devices for manually lifting and/or transporting a load, and particularly to a wearable load carrier supported by the back and shoulders of the user that is adjustable to receive and carry loads of varying sizes and configurations.

2. Description of the Related Art

Both at home and at work, it is sometimes necessary to resort to wearable load-carrying equipment, such as backpacks and the like, to lift, carry, move, or transport heavy or awkwardly shaped load while leaving the hands free to perform other tasks. It is obviously desirable for such load-carrying equipment to be comfortable, but also to support and distribute the load in such a manner that it eases the task of carrying heavy items over distances while reducing the risk of muscle strain, and accommodates items of various sizes, weights, and configurations.

Traditional backpacks, which are designed to carry heavy loads over extended periods of time, are typically based on rigid or semi-rigid frames. These frames are typically internal or external to the main backpack and provide structure to the backpack for load distribution. Such backpack frames are often equipped with adjustable shoulder supports and a waist belt to most effectively and comfortably locate the backpack load on the back of the wearer. However, in addition to heavy and unwieldy frames, such backpacks only adjust with regard to supporting straps, and no adjustment or customization is provided for the carrying portion, i.e., the frame itself is not adjustable, nor are any additional supports provided for the equipment being carried.

The lack of customization and adjustability in such conventional backpacks may require that the load carried by the frame be pushed away from the back of the wearer, moving the center of gravity away from the body of the wearer. Further, although such backpacks typically employ adjustable shoulder straps and an adjustable waist belt, the backpacks must be removed from the back of the wearer each time items are to be added or removed from the back of the user. Thus, a wearable load carrier solving the aforementioned problems is desired.

SUMMARY

The wearable load carrier is a body-mounted carrier for carrying and transporting loads, such as boxes, packages, containers and the like. The wearable load carrier is supported by the back and shoulders of the user, and is adjustable to receive and carry loads of varying sizes and configurations. The wearable load carrier includes an opposing pair of rails, each rail having an upper end and a lower end, and a plurality of belts and straps for selectively securing the carrier to the torso of the user. A height adjustable support platform extends between the rails is provided for supporting the load. The support platform has front and rear edges, the front edge being adjustably secured to and extending between the rails. A pair of height-adjustable handles are also adjustably secured to the rails.

A pair of shoulder straps are provided to be worn over the shoulders of the user. Respective first ends of the pair of shoulder straps are secured to the upper ends of the rails. A chest strap is secured to central portions of the pair of rails and is adapted to be worn about the user's chest. A waist strap, adapted to be worn about the user's waist, is secured to the lower ends of the pair of rails. A pair of lower rail straps selectively engage the shoulder straps.

These and other features of the present invention will become readily apparent upon further review of the following specification.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
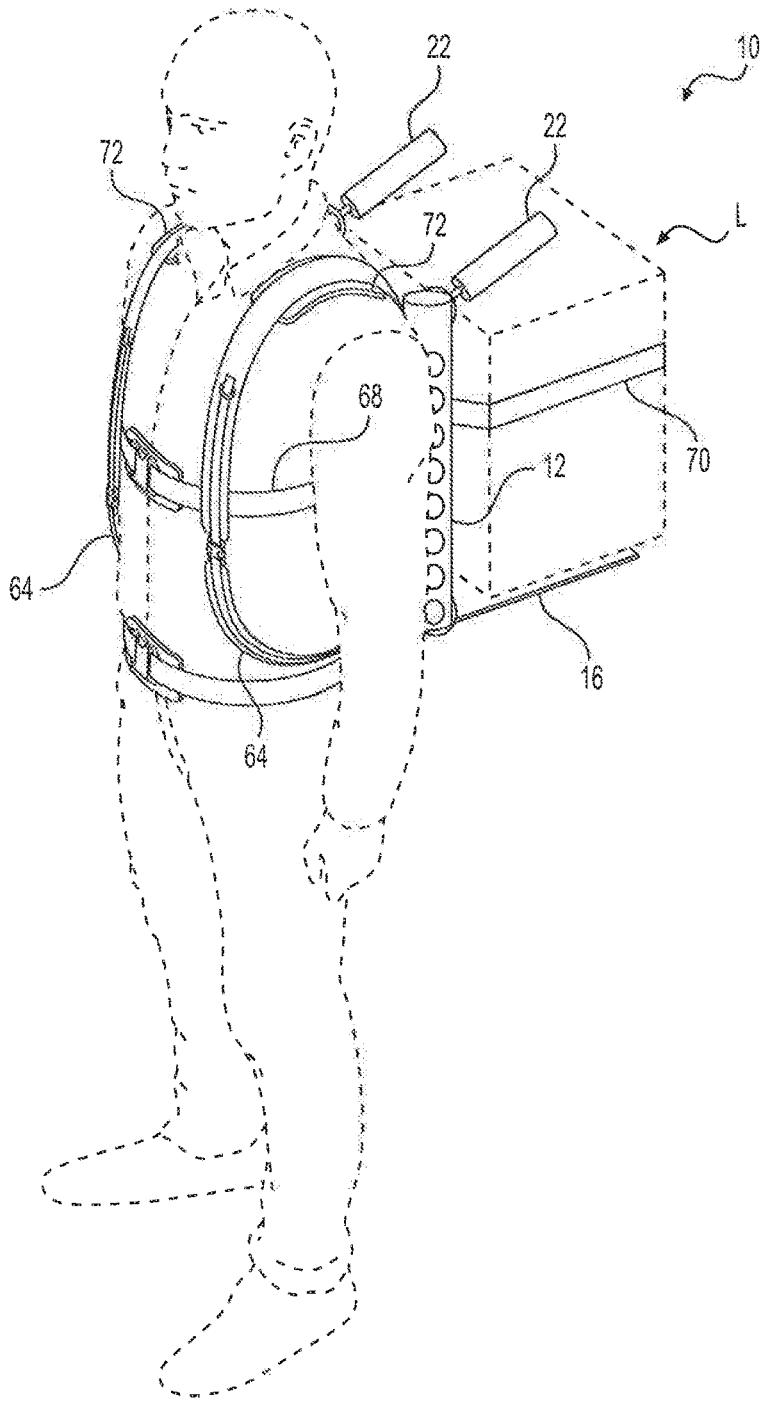
FIG. 1 is an environmental perspective view of a wearable load carrier.
Figure 2:
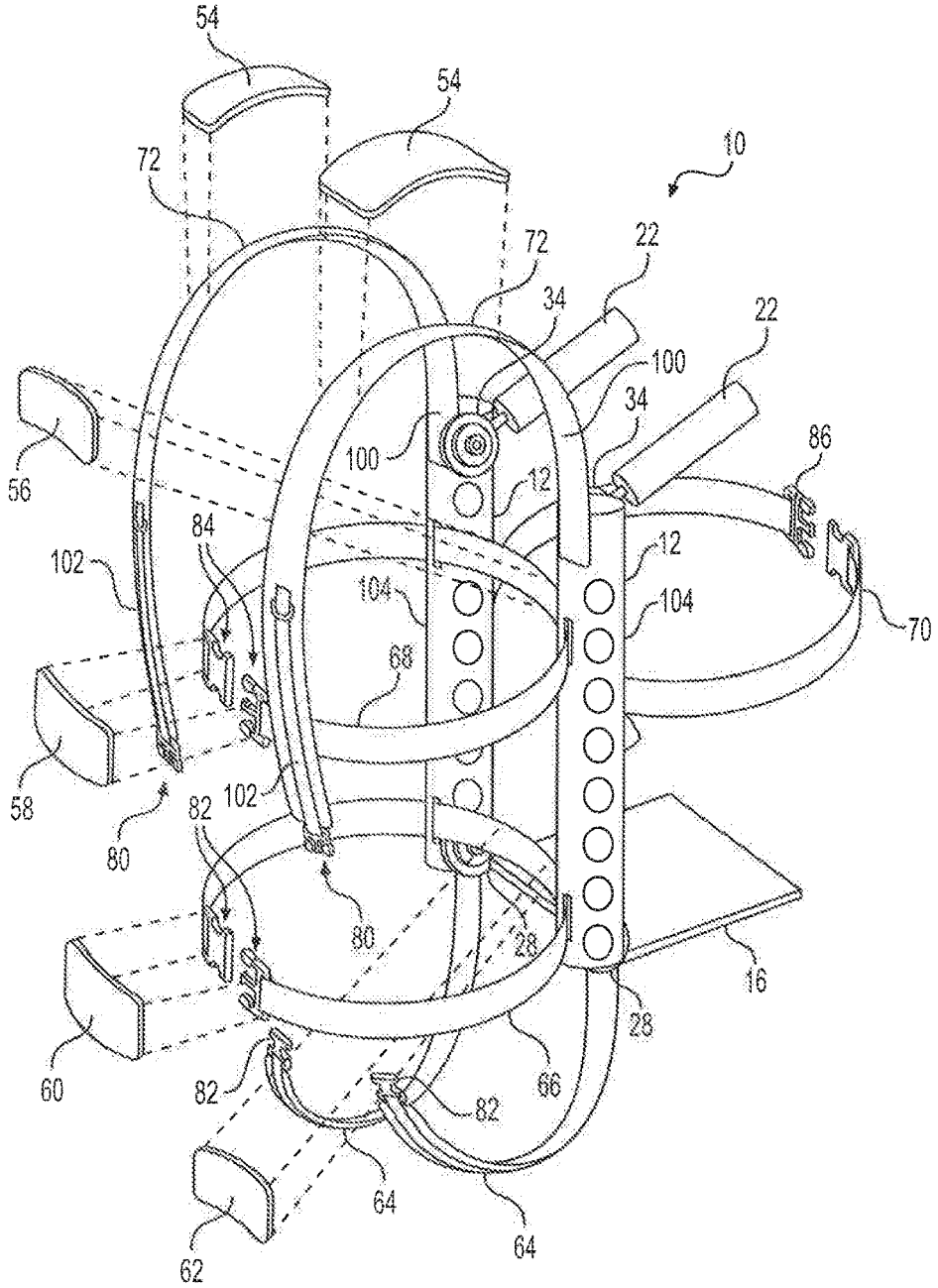
FIG. 2 is a perspective view of the wearable load carrier of FIG. 1.
Figure 3:
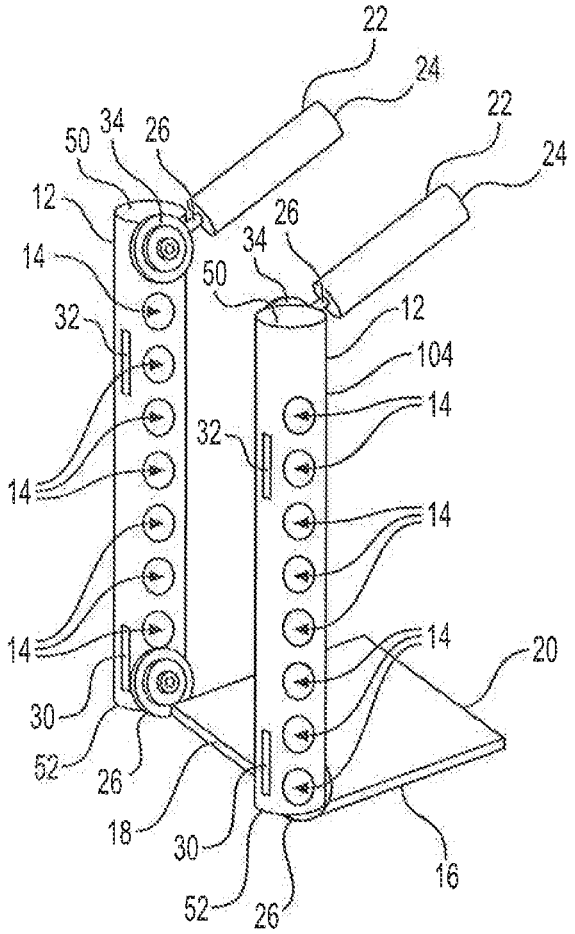
FIG. 3 is a partial perspective view of the wearable load carrier of FIG. 1, the belts and straps being removed.

As shown in FIG. 1, the wearable load carrier 10 is a body mounted carrier for carrying and transporting loads L, such as boxes, packages, containers and the like. It should be understood that the load L is shown in FIG. 1 for exemplary purposes only. As shown in FIG. 1, the wearable load carrier 10 may be supported on the back and shoulders of the user (although it may also be reversed, so that the load is supported in front of the user by the shoulders and chest) and is adjustable to receive and carry loads of varying sizes and configurations. As best seen in FIGS. 2 and 3, the wearable load carrier 10 includes a pair of opposed rails 12, each having an upper end and a lower end 50, 52, respectively, which form part of a frame worn on the back of the user. It should be understood that the elongated cylindrical rails 12 shown in FIGS. 2 and 3 are show for exemplary purposes only, and that the rails 12 may have any desired overall relative dimensions and configuration.

A support platform 16 is provided for supporting the load L. The support platform 16 has front and rear edges 18, 20, respectively. The front edge 18 is secured to and extends between the pair of rails 12. The support platform 16 is also height adjustable with respect to the pair of rails 12. The adjustment of the height and the angle of the support platform 16 with respect to the pair of rails 12 allows the wearable load carrier 10 to be used with loads L of varying shape and size. A pair of handles 22 are also provided, which may be rotated forward and pulled by the user to minimize the moment generated by the load around the low back. Each handle 22 has a free end 24 and a fixed end 26, which is releasably secured to a respective one of rails 12. Each handle 22, similar to support platform 16, may have its height and angle with respect to the pair of rails 12 adjusted.

Figure 4:
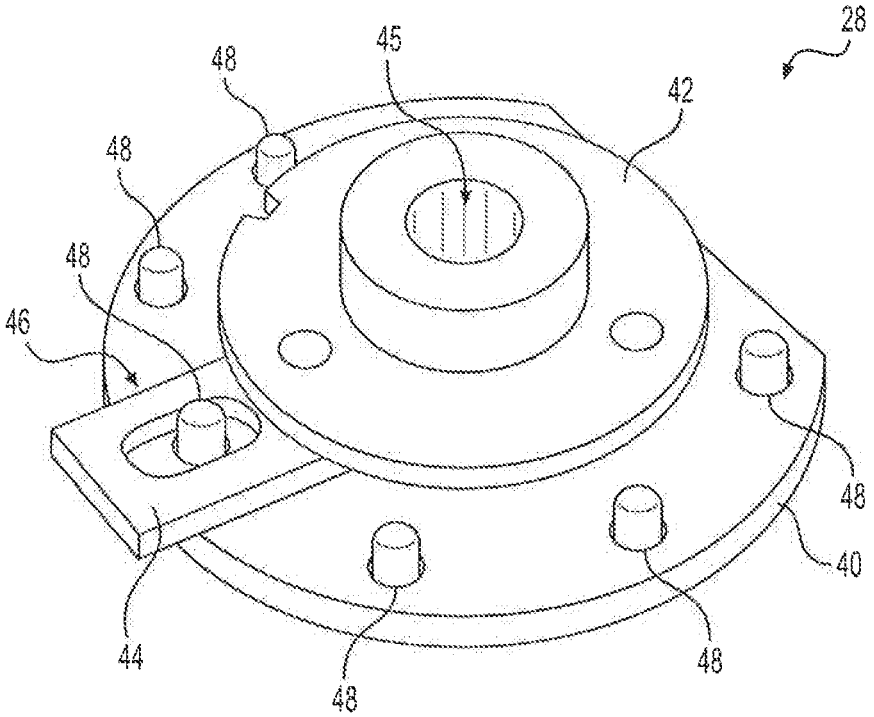
FIG. 4 is a perspective view of a spring clip torque hinge of the wearable load carrier, used to adjust the angle of the platform and the handles.
Figure 5:
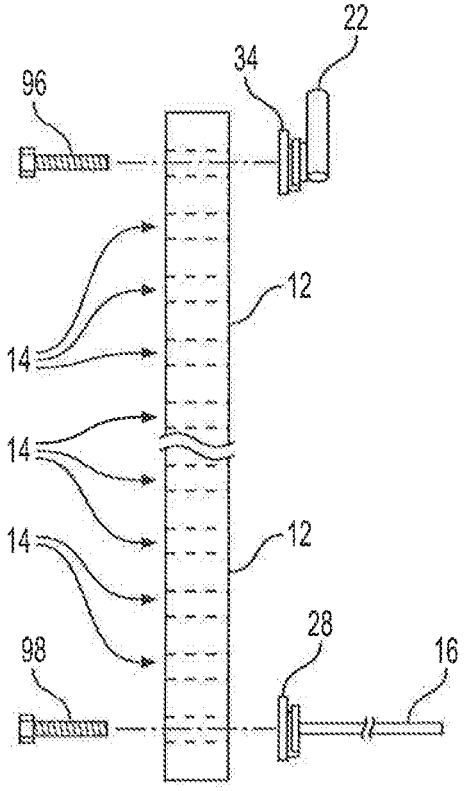
FIG. 5 is an exploded partial side view of a rail of the wearable load carrier of FIG. 1, showing releasable attachment of the platform and a handle to a rail of the wearable load carrier.

It should be understood that any suitable type of releasable connector may be used for the angular and height adjustments of handles 22 and support platform 16. In the example shown in the drawing Figures, each rail 12 has a plurality of spaced bore holes 14 defined therein extending from the upper end 50 to the lower end. In this example, a first pair of hinge plates 28 are respectively secured to laterally opposed edges of the support platform 16 (as shown in FIG. 5), and similarly, a second pair of hinge plates 34 are respectively secured to the pair of handles 22. FIG. 4 illustrates an example of such a hinge, including a first disc 40 and a second disc 42 pivotally secured thereto. A locking member 44, which is permanently and rigidly mounted to the second disc 42, has an aperture 46 formed therein for receiving a spring-loaded detent pin 48, which is mounted on the first disc 40. The first disc 40 has a plurality of spring-loaded detent pins 48 mounted thereon corresponding to the angles it may be desired to tilt the platform 16 to, or to rotate the handles 22 to. When it is necessary to tilt the platform 16 to a different angle, or to rotate the handles 22 to a different angle, the user only needs to press down on the spring-loaded detent pin 48 to lower it below the aperture 46 and rotate the locking member 44 to the desired detent pin 48 depress the desired detent pin 48, and rotate the locking member so that the desired detent pin 48 engages the aperture 46. This allows the second disc 42 to be selectively angularly locked in placed with respect to the first disc 40 to tilt the platform 16 (or change the angle of the handles 22). As will be described in greater detail below, a central bore 45 is adapted for receiving a bolt for releasably securing the hinge to one of the rails 12 at the desired height.

As best shown in FIG. 5, the first disc of each spring clip torque hinge 28 is secured to one side edge of the support platform 16. A first pair of bolts 98 are provided for releasably securing the first pair of hinge plates 28 and the support platform 16 to the pair of rails 12 through engagement with selected first pairs of the bore holes 14. Similarly, the first disc of each spring clip torque hinge 34 is secured to a corresponding one of the handles 22. A second pair of bolts 96 is provided for releasably securing the second pair of spring clip torque hinges 34 and the handles 22 to the pair of rails 12 through engagement with selected second pairs of the bore holes 14.

As best seen in FIG. 2, a pair of shoulder straps 72 are provided to be worn over the shoulders of the user. Respective first ends 100 of the pair of shoulder straps 72 are secured to the upper ends 50 of the pair of rails 12. A chest strap 68 is secured to central portions 104 of the pair of rails 12 and is adapted to be worn about the user's chest. A waist strap 66, adapted to be worn about the user's waist, is secured to the lower ends 52 of the pair of rails 12. As shown, second ends 102 of the pair of shoulder straps 72 may be releasably attached to the lower straps 64 by any suitable type of connector 80, such as the quick release or side release buckles 82 conventionally associated with backpacks and the like. Similarly, chest strap 68 may be releasably secured about the user's chest using side release buckles 84 or any other suitable type of connector, such as those conventionally associated with backpacks and the like. Waist strap 66 may be releasably secured about the user's waist using side release buckles 82 or any other suitable type of connector, such as those conventionally associated with backpacks and the like. The pair of lower straps 64 extend from the lower ends 52 of the rails 12. It should be understood that each strap 64, 66, 68, 72 may include size adjusters for adjusting the length thereof, similar to conventional backpack straps. Additionally, as shown in FIG. 2, a rear strap 70 may be provided for securing the load L in place. Similar to the other straps, the rear strap 70 may include a quick release or side release buckle 86, such as those conventionally associated with backpacks and the like.

Returning to FIG. 3, a pair of central slots 32 are respectively formed through the central portions 104 of the pair of rails 12, and a pair of lower slots 30 are respectively formed through the lower ends 52 of the pair of rails 12. As shown in FIG. 2, the chest strap 68 passes through the pair of central slots 32, and the waist strap 66 passes through the pair of lower slots 30. Additionally, as shown in FIG. 2, a pair of chest pads 54, 56 may be releasably secured to the chest strap 68 (shown in this example as being attached to the rear and front of the chest strap 68). Similarly, a pair of shoulder pads 54 may be releasably secured to the shoulder straps 72. In a similar manner, a pair of waist pads 60, 62 may also be releasably secured to the waist strap 66 (shown in this example as being attached to the rear and front of the waist strap 66). It should be understood that any suitable type of padding may be utilized, and that the pads may be releasably attached to their respective straps by any suitable type of releasable attachment, such as hook and loop fasteners or the like.

It is to be understood that the wearable load carrier is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

I claim:

1. A wearable load carrier, comprising:

a pair of rails, each of the rails having an upper end, a lower end, and a central portion between the upper and lower ends, wherein each the rails has a plurality of bore holes formed therein and spaced apart from the upper end to the lower end;

a support platform having a front edge and a rear edge, the front edge of the support platform releasably attached to and extending between the pair of rails, wherein the support platform is height adjustable with respect to the pair of rails;

a pair of shoulder straps, each of the shoulder straps having a first end and a second end, the first end of each of the shoulder straps being attached to the upper ends of the pair of rails, the pair of shoulder straps being adapted to be worn over the shoulders of a user;

a chest strap attached to the central portions of the pair of rails, the chest strap being adapted to be worn about a chest of the user;

a pair of lower straps, each of the lower straps having a first end attached to the lower end of the rails and a second end selectively attached to the shoulder straps;

a waist strap attached to the lower ends of the pair of rails, the waist strap being adapted to be worn about a waist of the user;

a first pair of hinges mounted on laterally opposed edges of the support platform, the first pair of hinges being selectively locked to adjust tilt of the support platform with respect to a user's back and torso; and a first pair of bolts for releasably securing the first pair of hinges and the support platform to the pair of rails through engagement with a user-selectable aligned pair of the bore holes to adjust the height of the support platform.

2. The wearable load carrier as recited in claim 1, further comprising a pair of handles releasably attached to the pair of rails.

3. The wearable load carrier as recited in claim 2, wherein the pair of handles is height adjustable with respect to the pair of rails.

4. The wearable load carrier as recited in claim 3, further comprising:

a second pair of hinges attaching the pair of handles to the rails, the hinges being selectively locked to adjust the handles at selected angles extending forward and backward; and a second pair of bolts for releasably securing the second pair of hinges and the pair of handles to the pair of rails through engagement with a user-selectable aligned pair of the bore holes to adjust the height of the pair of handles.

5. The wearable load carrier as recited in claim 1, further comprising a pair of shoulder pads releasably secured to the pair of shoulder straps.

6. The wearable load carrier as recited in claim 5, further comprising a pair of chest pads releasably secured to the chest strap.

7. The wearable load carrier as recited in claim 6, further comprising a pair of waist pads releasably secured to the waist strap.

8. The wearable load carrier as recited in claim 1, wherein said rails have a pair of central slots defined in the central portions of said rails, the chest strap passing through the pair of central slots.

9. The wearable load carrier as recited in claim 1, wherein said rails have a pair of lower slots defined in the lower ends of the pair of rails, the waist strap passing through the pair of lower slots.

* * * * *